US005971813A

United States Patent [19]

Kunz et al.

[11] Patent Number: 5,971,813

[45] Date of Patent: Oct. 26, 1999

[54] RJ-45 MODULAR CONNECTOR WITH MICROWAVE-TRANSMISSION-LINE INTEGRATED SIGNAL CONDITIONING FOR HIGH SPEED NETWORKS

[75] Inventors: William E. Kunz, Portola Valley, Calif.; Avon McCamey, Pocahontas, Ark.

[73] Assignee: Regal Electronics, Inc., Santa Clara, Calif.

[21] Appl. No.: 09/053,811

[22] Filed: Apr. 1, 1998

[51] Int. Cl.[6] ..... H01R 23/02

[52] U.S. Cl. ..... 439/676; 439/941

[58] Field of Search ..... 439/676, 941, 439/620

[56] References Cited

U.S. PATENT DOCUMENTS

| | | | |
|---|---|---|---|
| 5,069,641 | 12/1991 | Sakamoto et al. | 439/620 |
| 5,295,869 | 3/1994 | Siemon et al. | 439/620 |
| 5,362,257 | 11/1994 | Neal | 439/676 |
| 5,474,474 | 12/1995 | Siemon et al. | 439/620 |
| 5,587,884 | 12/1996 | Raman | 361/728 |
| 5,647,765 | 7/1997 | Haas et al. | 439/609 |
| 5,647,767 | 7/1997 | Scheer et al. | 439/620 |
| 5,656,985 | 8/1997 | Lu et al. | 336/96 |
| 5,687,233 | 11/1997 | Loudermilk et al. | 379/442 |

OTHER PUBLICATIONS

Stewart Connector, MagJack Modular Jacks with Integrated Magnetics, 72 Series, SCS–MJ–Nov. 1997.

*Primary Examiner*—Neil Abrams
*Assistant Examiner*—Javaid Nasri
*Attorney, Agent, or Firm*—Thomas E. Schatzel; Law Offices of Thomas E. Schatzel, A Prof. Corporation

[57] ABSTRACT

A modular connector comprises an insulative housing that accepts an RJ-45 style jack from its front, and a molded insert from the opposite side. Each molded insert includes a signal conditioning circuit that provides a proper electrical coupling between a physical interface device (PHY) or encoder/decoder and an unshielded twisted pair (UTP) cable to a high speed computer network. Such signal conditioning comprises a common mode choke for each of the transmitter and receiver circuit pairs that are constructed from twin-lead transmission line sections. Each common mode choke comprises two stiff wire conductors that are brought together at a uniform critical separation distance for a critical longitudinal run length. The wire size, surrounding dielectric, separation distance, and run length are all controlled to arrive at a common-mode choke equivalent with series inductance, transformer coupling, and capacitance values suitable for use with 100BASE-T Fast Ethernet and 1000BASE-T Gigabit Ethernet.

7 Claims, 3 Drawing Sheets

RJ-45 MODULAR CONNECTOR WITH MICROWAVE-TRANSMISSION-LINE INTEGRATED SIGNAL CONDITIONING FOR HIGH SPEED NETWORKS

FIELD OF THE INVENTION

The present invention relates to electronic jacks and connectors, and more particularly to modular phone-style RJ45 Category-5 unshielded twisted pair (UTP) network media interface connectors.

DESCRIPTION OF THE PRIOR ART

Highly reliable networks are critical to the success of the enterprise, so ease of installation and support are primary considerations in the choice of network technology. Since the introduction in 1986 of star-wired "10BASE-T" hubs, structured wiring systems have continued to evolve and hubs and switches have become increasingly reliable. Today, Ethernet networks are rapidly approaching the reliability level associated with their telephone ancestors, and are relatively simple to understand and administer.

Ethernet technology is ubiquitous. More than eighty-three percent of all installed network connections were Ethernet by the end of 1996 according to IDC Corporation. This represents over 120 million interconnected personal computers, workstations and servers. The remaining network connections are a combination of Token Ring, Fiber Distributed Data Interface (FDDI), Asynchronous Transfer Mode (ATM) and other protocols. All popular operating systems and applications are Ethernet-compatible, as are upper-layer protocol stacks such as transmission control protocol/internet protocol (TCP/IP), IPX, NetBEUI and DECnet.

The Fast Ethernet (100BASE-T) standard was approved in 1995 and established Ethernet as a scaleable technology. Now, the development of Gigabit Ethernet (1000BASE-T) extends the scalability of Ethernet even further. Gigabit Ethernet is an extension to the highly successful ten Mbps and one hundred Mbps IEEE 802.3 Ethernet standards. Offering a raw data bandwidth of one thousand Mbps, Gigabit Ethernet maintains full compatibility with the huge installed base of Ethernet nodes.

Network interface connections have conventionally included some form of signal conditioning near the RJ-45 category-3 or category-5 modular connector. The usual purpose is to block spurious signals, e.g., high frequency noise, differential-mode direct current (DC), and common mode voltages. Various magnetics assemblies from HALO Electronics (Redwood City, Calif.) like the ULTRA™ series of 16-pin SOIC isolation modules are used to meet the requirements of IEEE Standard 802.3 for 10/100BASE-TX and ATM155 applications. A very informative background on connectors and their network applications, and a long citation of prior art, is provided by John Siemon, et al., in U.S. Pat. No. 5,474,474, issued Dec. 12, 1995. Such patent is incorporated herein by reference.

A few artisans have described signal condition components placed inside the bodies of modular connectors. For example, Peter Scheer, et al., describe a connector jack assembly with a rear insert that includes signal conditioning components, in U.S. Pat. No. 5,647,767, issued Jul. 15, 1997. However, the descriptions show there is a rather large housing extension necessary in the back of the connectors to accommodate a horizontally oriented printed circuit board. The footprint that results would prohibit the embodiments of Peter Scheer, et al., from being able to make a form, fit, and function substitution of ordinary connectors already designed into various network products. Venkat A. Raman also describes another connector jack with an insert body having encapsulated signal conditioning components, in U.S. Pat. No. 5,587,884, issued Dec. 24, 1996. A common mode choke and other magnetics are described as being encapsulated in the insert molding. The Raman disclosure also describes a rather large connector housing to accommodate a small horizontally oriented printed circuit board for the magnetics in the rear. So it too would not be able to directly substitute for many of the standard connections being marketed.

Gregory Loudermilk, et al., recognized the need for a filtered modular jack that provides the signal conditioning needed by high speed communications systems, and that "occupies approximately the same amount of board space on a printed circuit motherboard as do current modular jacks". But then their U.S. Pat. No. 5,687,233, issued Nov. 11, 1997, diagrams and describes a mounting pin array with a large extension to the rear to accommodate a transmit and receiver printed circuit board in a rear housing.

A very modest rearward extension to an RJ-11 modular jack is described by Yukio Sakamoto, et al., in U.S. Pat. No. 5,069,641, issued Dec. 3, 1991. A small printed circuit board is shown vertically oriented directly above the line of mounting pins and has a common mode choke coil mounted to it. Gregory Loudermilk, et al., commented that Yukio Sakamoto, et al., did not teach signal conditioning in their RJ-11 connector that was sophisticated enough for high speed applications like LAN and ATM switches. The basic criticism was that the Sakamoto disclosure may have been sufficient for 10BASE-T Ethernet connections, but not good enough for 100BASE-T Fast Ethernet connections.

The signal conditioning described by all those mentioned here will probably fall far short of what is going to be required to convert to 1000BASE-T Gigabit Ethernet. At such high operating frequencies, circuit impedances no longer stay lumped. Short pieces of wire can have very high inductive reactances, and closely positioned wires and components can have significant mutual, distributed, and parasitic capacitances. Therefore, the engineering of 1000BASE-T Gigabit Ethernet RJ-45 modular connectors need to include microwave design techniques that account for transmission line effects.

SUMMARY OF THE INVENTION

It is therefore an object of the present invention to provide a modular connector with integrated signal conditioning for 100BASE-T Fast Ethernet and 1000BASE-T Gigabit Ethernet.

It is a further object of the present invention to provide a transmission line effects solution to the problem of integrated signal conditioning in multi-port modular connector systems for printed circuit board mounting.

It is a still further object of the present invention to provide a modular connector system that will reliably survive motherboard solder operations during the assembly of other components.

Briefly, a modular connector embodiment of the present invention comprises an insulative housing that accepts a RJ-45 style jack from its front, and a molded insert from the opposite side. Each molded insert includes a signal conditioning circuit that provides a proper electrical coupling between a physical interface device (PHY) or encoder/decoder and an unshielded twisted pair (UTP) cable to a high speed computer network. Such signal conditioning comprises a common mode choke for each of the transmitter and receiver circuit pairs that are constructed from twin-lead transmission line sections. Each common mode choke comprises two stiff wire conductors that are brought together at a uniform critical separation distance for a critical longitudinal run length. The wire size, surrounding dielectric, separation distance, and run length are all controlled to arrive at a common-mode choke equivalent with series inductance, transformer coupling, and capacitance values suitable for use with 100BASE-T Fast Ethernet and 1000BASE-T Gigabit Ethernet.

An advantage of the present invention is that a modular connector is provided that can be used to retrofit ordinary modular connectors because the integrated signal conditioning does not require a back extension to the main housing.

Another advantage of the present invention is that a modular connector is provided with integrated signal conditioning that will not disconnect during soldering operations of the motherboard.

These and other objects and advantages of the present invention will no doubt become obvious to those of ordinary skill in the art after having read the following detailed description of the preferred embodiments which are illustrated in the various drawing figures.

IN THE DRAWINGS

Figure 10:
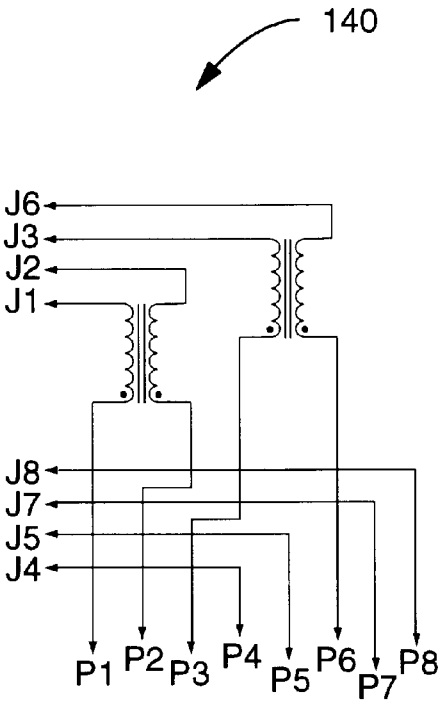
Figure 9:
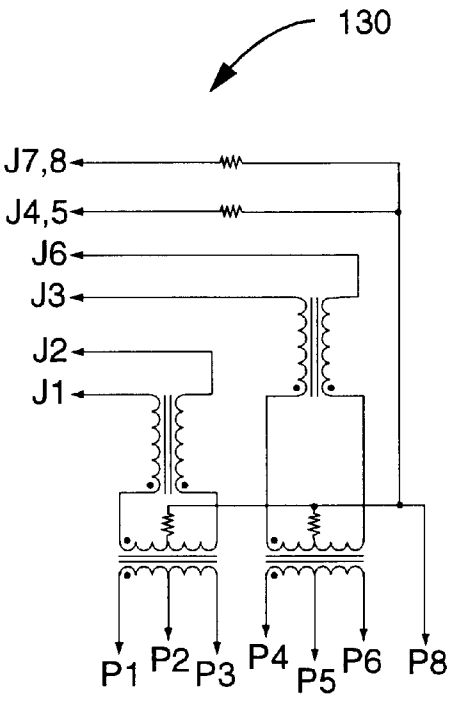

FIG. 9 is a schematic diagram of a DC blocking and series choke circuit, as may be required in the coupling of a PHY device to a cable medium in a 100BASE-T network application, and that may be implemented within the plastic insert body shown in FIGS. 1–7; and FIG. 10 is a schematic diagram of a common mode choke circuit, as may be required in the coupling of a PHY device to a cable medium in a 100BASE-T network application, and that may be implemented within the plastic insert body shown in FIGS. 1–7.

DETAILED DESCRIPTION OF THE PREFERRED EMBODIMENT

Figure 1:
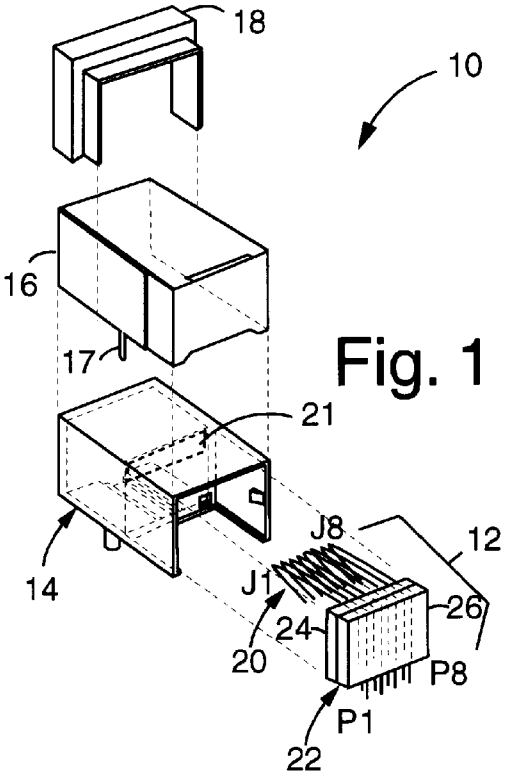
FIG. 1 is a perspective exploded assembly diagram of a single-port modular connector embodiment of the present invention.
Figure 5:
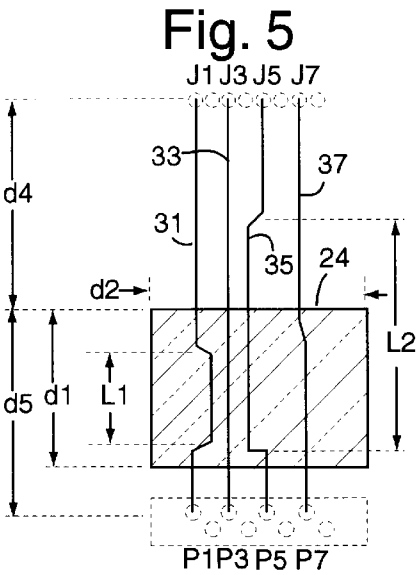
FIG. 5 is a rear view of the back insert halves of FIGS. 1–4 with the spring wire contact parts laid flat for the diagram so that critical bends and kinks in the wire can be better illustrated.
Figure 7:
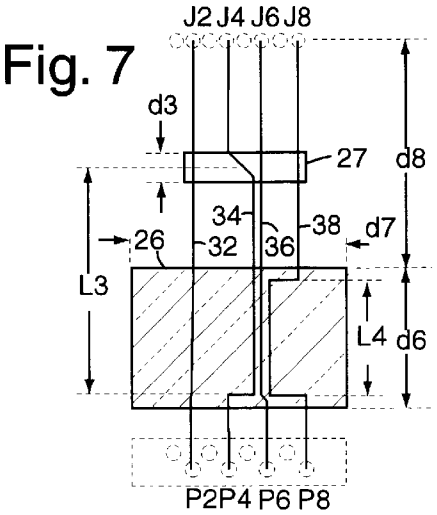
FIG. 7 is a rear view of the front insert halves of FIGS. 1–3 and 6 with the spring wire contact parts laid flat for the diagram so that critical bends and kinks in the wire can be better illustrated.
Figure 6:
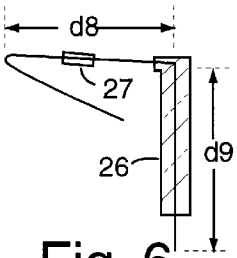
FIG. 6 is a side view of the front insert halves of FIGS. 1–3 and is intended to show that the wire connections rise vertically within the plastic insert body and then turn perpendicular to run parallel with a motherboard the modular connector may be mounted to. The left ends of the conductors in the diagram are curled back under to form another set of spring wire contacts to an RJ-45 jack.
Figure 4:
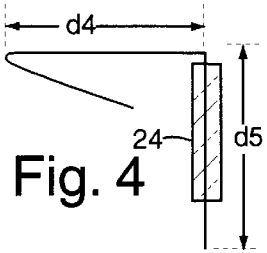
FIG. 4 is a side view of the back insert halves of FIGS. 1–3 and is intended to show that the wire connections rise vertically within the plastic insert body and then turn perpendicular to run parallel with a motherboard the modular connector may be mounted to. The left ends of the conductors in the diagram are curled back under to form a set of four spring wire contacts to an RJ-45 jack.

FIG. 1 illustrates a single-port printed-circuit-board (PCB) mount modular connector embodiment of the present invention, referred to herein by the general reference numeral 10. The modular connector 10 comprises a snap-in insert assembly 12 that installs into a back end of a plastic housing 14 and solders down to a PCB. A metal Faraday shield 16 covers the top, sides and back of the assembled insert 12 and housing 14 and provides for electromagnetic-radiation (EMR) protection. A tab 17 is intended to be soldered to a groundplane of the PCB. A conductive flexible gasket 18 is used to collar the front end of the assembled housing 14 and shield 16 and provide RJ-45 jack grounding by bridging the small distance to an installed jack. For further details of this construction, see, U.S. Pat. No. 5,647,765, issued Jul. 15, 1997, to Haas, et al. Such Patent is incorporated herein by reference.

A group of spring connectors 20 passes through a hole 21 in a dividing wall within the housing 14 to ultimately connect with any RJ-45 plugged in from the front. The RJ-45 connection system is an industry standard and is ubiquitous in the data network industry. The group of spring connectors 20 provides for eight industry defined circuit connections that pass through a plastic insert body 22.

The typical RJ-45 connection to a data network is part of the physical interface layer and requires a modest amount of signal conditioning. It is critical to the present invention that such signal conditioning be implemented entirely within the volume of the insert body 22, and especially not off-connector on the PCB or in a "dog-house" back extension. The pin-out, pin placements, and overall form factor of the modular connector 10 are critical because it must the be form, fit, and function equivalent to preexisting PCB's that were designed for prior art modular connectors. The point of mounting the signal conditioning inside the insert body 22 is to save the PCB real estate that would otherwise be needed or not available, and to gain the EMR-related advantage of being inside the Faraday shield 16.

Figure 2:
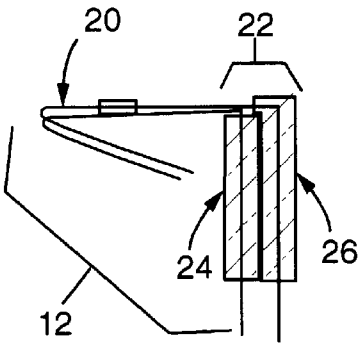
FIG. 2 is a side view of the front and back insert halves used in the modular connector of FIG. 1.

FIG. 2 shows that the insert body 22 actually comprises a front insert half 24 and an back insert half 26, both of which are made from a plastic with good dielectric characteristics at near microwave frequencies.

Figure 3:
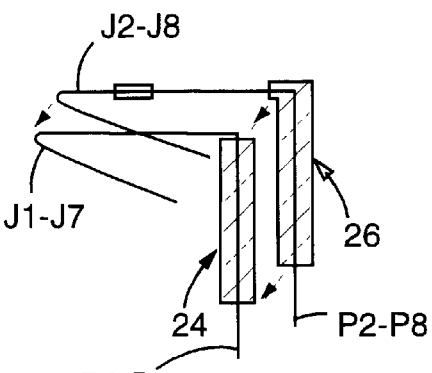
FIG. 3 is a side view of the front and back insert halves of FIG. 2 before being joined together to illustrate which structures belong to each part.

FIG. 3 shows how the front insert half 24 and back insert half 26 are joined together. The front insert half 24 supports spring connection jacks J1, J3, J5, and J7 at the top, and PCB mounting pins P1, P3, P5, and P7 at the bottom. Such PCB mounting pins are on 0.100 inch centers and phosphor bronze 510 spring temper 0.014 inch material is used for all of J1–P1 through J7–P7. The back insert half 26 supports spring connection jacks J2, J4, J6, and J8 at its top, and PCB mounting pins P2, P4, P6, and P8 at its bottom. Such PCB mounting pins are also on 0.100 inch centers, but staggered 0.050 inch relative to PCB mounting pins P1, P3, P5, and P7. Phosphor bronze 510 spring temper 0.014 inch wire material is used for all of J2–P2 through J8–P8.

FIGS. 4–7 show details of how the wire material for J1–P1 through J8–P8 is bent and kinked in order to make the necessary connections and to inject controlled inductances and capacitances respectively between J1–J8 and P1–P8.

The techniques used here are borrowed from ultra high frequency (UHF) and microwave practice where sections of transmission lines are used to match impedances, build inductive chokes, and implement various kinds of low-pass, bandpass, and high pass filter networks. Four reactive components L1–L4 are identified which have critical run lengths that are kinked nearer to an adjacent conductor within front insert half 24 and back insert half 26. The separation distance, the run length, and the dielectric between are all independent variables that will affect the reactive impedances of L1–L4.

Referring now to FIGS. 4–7, for an exemplary RJ-45 style modular connector, a dimension "d1" is about 0.450 inches, "d2" is about 0.500 inches, "d3" is about 0.125 inches, "d4" is about 0.625 inches, and "d5" is about 0.625 inches. A plastic keeper 27 (FIGS. 6 and 7), prevents the spring connectors from roaming too much while the assembly 12 is outside the housing 14.

A dimension "d6" is about 0.4375 inches, "d7" is about 0.500 inches, "d8" is about 0.500 inches, and "d9" is about 0.625 inches.

A representive set of eight conductor segments 31–38 each respectively connect between J1–J8 and P1–P8. Parts of each conductor segment 31–38 are bent or kinked toward or away from another.

Figure 8:
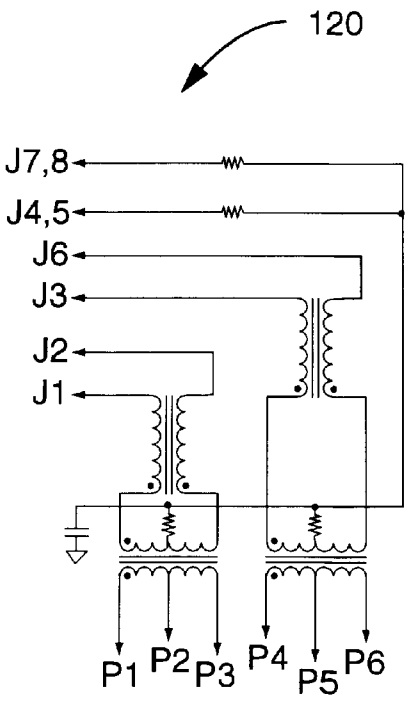
FIG. 8 is a schematic diagram of a DC blocking and filter-capacitor circuit, as may be required in the coupling of a PHY device to a cable medium in a 100BASE-T network application, and that may be implemented within the plastic insert body shown in FIGS. 1–7.

FIG. 8 represents a DC blocking and filter-capacitor circuit 120 for coupling a PHY device through the PCB pins P1–P6 to a cable medium in a 100BASE-T network application through RJ-45 jack connections J1–J8. Such DC blocking and filter-capacitor circuit 120 may be implemented within the integrated signal conditioning part of plastic insert body 22.

FIG. 9 represents a DC blocking and series choke circuit 130 for coupling a PHY device through the PCB pins P1–P6 to a cable medium in a 100BASE-T network application through RJ-45 jack connections J1–J8. Such DC blocking and series chock circuit 130 may be implemented within the integrated signal conditioning part of plastic insert body 22.

FIG. 10 represents a common-mode choke circuit 140 for coupling, e.g., a PHY device, through the PCB pins P1–P6 to a cable medium in a 100BASE-T network application through RJ-45 jack connections J1–J8. Such common-mode choke circuit 140 may be implemented within the integrated signal conditioning part of plastic insert body 22.

Fast Ethernet 100BASE-TX uses two pairs of category-5 balanced cable, or two pairs of 150 ohm shielded balanced cable (as defined by ISO/IEC 11801). Fast Ethernet 100BASE-FX uses two multi-mode fibers as defined by ISO 9314. Fast Ethernet 100BASE-T4 uses four pairs of category-3, -4 or -5 balanced cable (as defined by ISO/IEC 11801). In each case, the length of a twisted-pair segment, from computer to wiring closet, may be up to 100 meters (328 feet). This distance is identical to that used by 10BASE-T links. Cable bundles such as 25-pair cables cannot be used with 100BASE-T. There is no provision for coaxial cable support or bus wiring methods. A 100BASE-TX system is similar to 10BASE-T in that one pair is used to transmit while the other pair is used to detect a data packet collision. This system defines a half-duplex link. The physical properties of transmission are more difficult to deal with at one hundred Mbps than at ten Mbps. Therefore, better cable, connectors and jacks, and more sophisticated transmission encoding must be used. Unshielded cable must conform to rather rigorous category-5 specifications. The transmission scheme uses a block-code known as "4B/5B," creating a transmission frequency of one hundred twenty-five MHz. The 100BASE-T4 "PHY" is designed to work with category-3 cables (Ethernet). Such cables usually have poor noise responses above twenty-five MHz and will not meet FCC or European emission standards. Four pairs of category-3 wire must be used to get satisfactory results, e.g., the signal is split amongst the wire pairs and encoded using a block code known as "8B6T". The resulting link can be up to one hundred meters (three hundred twenty-eight feet) long, and 25-pair bundle cables cannot be used.

An RJ-45 style modular connector of the present invention can therefore comprise a plastic rectangular housing with an open front end to receive a matching RJ-45 style modular jack, and an opposite open back end, a contact spring assembly of a plurality of wires in separate circuits that pass forward through the open back end into the back of the open front end of the housing, and that are supported past a right angle turn by a vertically oriented plastic block that inserts and locks into the open back end of the housing, a set of mounting pins for connection to a printed motherboard that are disposed at a bottom edge of the plastic block, and a plurality of transmission line segments disposed in the plastic block and providing an interface between a local area network (LAN) media cable connected to the contact spring assembly, and a physical layer device (PHY) of a network interface controller (NIC) through the mounting pins.

In alternative embodiments of the present invention, the RJ-45 style modular connector is such that the plurality of transmission line segments are constructed to form an electronic circuit that comprises a common-mode choke to suppress noise interference associated with an ETHERNET LAN operating on the LAN media cable that is constructed by bending and kinking the otherwise-parallel and uniformly spaced plurality of wires in separate circuits to run closer or farther apart from its neighboring wires over a length entirely within the plastic block. A pair of the wires on opposite sides of a middle wire can be bent or kinked toward the middle such that each has a closely spaced segment that runs parallel to the middle wire. Each such closely spaced segment that runs parallel to the middle wire actually includes a distributed capacitance that is proportional to a spacing and an inductance that is proportional to a run length of the respective segment.

In such embodiments, the electronic circuit comprises a common-mode choke useful to suppress noise interference associated with an ETHERNET LAN operating on the LAN media cable. Such common-mode choke is constructed by bending and kinking the otherwise-parallel and uniformly spaced plurality of wires in separate circuits to run closer or father apart from its neighboring wires over a length within the plastic block and a second length at right angles and extending forward in the spring assembly. A pair of the wires on opposite sides of a middle wire are bent or kinked toward the middle such that each has a closely spaced segment that runs parallel to the middle wire. Each closely spaced segment that runs parallel to the middle wire also comprises a distributed capacitance that is proportional to a spacing and an inductance that is proportional to a run length of the respective segment.

In general, the electronic circuit provides for an impedance matching of ETHERNET LAN signals between the set of mounting pins the LAN media cable.

In preferred embodiments of the present invention, the plastic block is divided in half into two overlying layers fore-and-aft where each supports and insulates about one-half of the plurality of wires and their respective connections to the mounting pins. The mounting pins are also organized into fore-and-aft rows that align with each of the two overlying layers of the plastic block.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An RJ-45 style modular connector, comprising:

a plastic rectangular housing (14) with an open front end to receive a matching RJ-45 style modular plug, and an opposite open back end;

a vertically oriented plastic block (22) that inserts and locks into said open back end of the housing;

a contact string assembly (12) of a plurality of wires in separate circuits that pass forward through said open back end into the back of said open front end of the housing, and that are supported past a right angle turn by the plastic block;

a set of mounting pins (P1–P8) for connection to a printed motherboard that are disposed at a bottom edge of the plastic block;

a plurality of transmission line segments (31–38) disposed in the plastic block (22) and providing an interface between a local area network (LAN) media cable connected to the contact spring assembly, wherein, the plurality of transmission line segments effectuate an electronic circuit (120, 130, 140) that suppresses noise interference associated with a LAN operating on said LAN media cable that is constructed by bending and kinking, but not twisting the otherwise-parallel and uniformly spaced said plurality of wires in separate circuits to run closer or farther apart from its neighboring wires over a length entirely within the plastic block;

the plastic block (22) is divided in half into two overlying layers (24, 26) fore-and-aft where each supports and insulates about one half of the plurality of wires (31–38) and their respective connections to the mounting pins (P1–P8); and said mounting pins (P1–P8) are organized into fore-and-aft rows that align with each of said two overlying layers of the plastic block.

2. The connector of claim 1, wherein:

a pair of said wires (31, 35 or 34, 38) on opposite sides of a middle wire (33 or 36) are bent or kinked toward the middle such that each has a closely spaced segment that runs parallel to said middle wire.

3. The connector of claim 2, wherein:

each said closely spaced segment that runs parallel to said middle wire (33 or 36) comprises a distributed capacitance that is proportional to a spacing and an inductance that is proportional to a run length of the respective segment.

4. The connector of claim 1, wherein:

the plurality of transmission line segments (31–38) effectuate an electronic circuit that comprises a transmission line section dimensionally manipulated to suppress noise interference associated with said LAN operating on said LAN media cable that is constructed by bending and kinking the otherwise-parallel and uniformly spaced said plurality of wires in separate circuits to run closer or farther apart from its neighboring wires over a length within the plastic block (22) and a second length at right angles and extending forward in the spring assembly (12).

5. The connector of claim 4, wherein:

a pair of said wires (31, 35 or 34, 38) on opposite sides of a middle wire (33 or 36) are bent or kinked toward the middle such that each has a closely spaced segment that runs parallel to said middle wire.

6. The connector of claim 5, wherein:

each said closely spaced segment (31–38) that runs parallel to said middle wire comprises a distributed capacitance that is proportional to a spacing and an inductance that is proportional to a run length of the respective segment.

7. The connector of claim 1, wherein:

the plurality of transmission line segments (31–38) effectuate an electronic circuit that provides for an impedance matching of LAN signals between said set of mounting pins and said LAN media cable.

* * * * *